US006234076B1

(12) United States Patent
Mizutani et al.

(10) Patent No.: US 6,234,076 B1
(45) Date of Patent: May 22, 2001

(54) IMAGE FORMING MACHINE WITH SHEET SUPPLYING AND DISCHARGING TABLES

(75) Inventors: Tomohiro Mizutani; Yasushi Kuratani; Hideaki Nogi, all of Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/422,233

(22) Filed: Oct. 21, 1999

(30) Foreign Application Priority Data

Oct. 26, 1998 (JP) ..... 10-304176

(51) Int. Cl.[7] ..... B65H 31/10
(52) U.S. Cl. ..... 101/118; 271/209; 271/215
(58) Field of Search ..... 101/118; 271/3.14, 271/4.01, 4.08, 10.01, 147, 152–155, 209, 214, 215, 217; 400/624, 625

(56) References Cited

U.S. PATENT DOCUMENTS 5,192,261 * 3/1993 Honjo et al. ..... 271/215
5,451,039 * 9/1995 Adachi ..... 271/147
5,741,009 * 4/1998 Kawano et al. ..... 271/214
5,893,555 * 4/1999 Kawada et al. ..... 271/155
5,975,521 * 11/1999 Ono et al. ..... 271/209
6,145,826 * 11/2000 Kawata ..... 271/215

* cited by examiner

*Primary Examiner*—Stephen R. Funk
(74) *Attorney, Agent, or Firm*—Kanesaka & Takeuchi

(57) ABSTRACT

An image forming machine includes an image forming section for receiving a sheet supplied in a supplying direction, printing an image on the sheet, and discharging the printed sheet in a discharging direction opposite to the supplying direction while changing the sheet upside-down; a sheet supplying table situated adjacent to the image forming section, the sheet supplying table stacking the sheet to be supplied to the image forming section; a sheet discharging table situated adjacent to the image forming section and disposed vertically relative to the sheet supplying table, the sheet discharging table stacking the sheet having the image printed thereon and discharged from the image forming section; driving mechanism attached to the sheet supplying table and the sheet discharging table for vertically moving the sheet supplying table and the sheet discharging table in directions opposite to each other.

8 Claims, 5 Drawing Sheets

IMAGE FORMING MACHINE WITH SHEET SUPPLYING AND DISCHARGING TABLES

BACKGROUND OF THE INVENTION

1. Field of the Invention

The present invention relates to an image forming machine such that both sides printing can be easily conducted although structure of a sheet supplying device and a sheet discharging device is simple.

2. Description of the Related Art

A stencil printing machine will be explained as an example of the image forming machine.

FIG. 5 illustrates an example of a conventional stencil printing machine. A cylindrical printing drum 100 is rotatable around an axis 100*a* thereof. An ink permeable area is formed in a part of a peripheral wall of the printing drum 100. Inside the printing drum 100, an ink supplying means 100*b* is situated for supplying ink to an inner circumferential surface of the peripheral wall. A clamping device 101 is attached to an outer circumferential surface of the peripheral wall of the printing drum 100 for holding a leading end of a stencil sheet. The stencil sheet held by the clamping device 101 at the leading end thereof is wound around the outer circumferential surface of the printing drum 100.

Beneath the printing drum 100, a cylindrical opposing drum 102 is rotatably situated. The opposing drum 102 is rigid and not deformed during printing. The diameter of the opposing drum 102 is approximately identical to that of the printing drum 100. An axis of the opposing drum 102 is parallel to the axis of the printing drum 100. The opposing drum 102 is arranged so as to practically contact the printing drum 100. A holding claw 103 is attached to an outer circumferential surface of the opposing drum 102. A recess 104 is formed in the outer circumferential surface of the opposing drum 102 for avoiding interference with the clamping device 101 of the printing drum 100.

The printing drum 100 and the opposing drum 102 are rotated in synchronization with each other and in directions opposite to each other. The drums convey a printing sheet while holding it therebetween, and conduct printing on it.

Above a sheet supplying table 105, a sheet supplying roller 106 is situated. Between the sheet supplying roller 106 and the printing drum 100, a timing roller 107 is situated. On a discharging side of the printing drum 100, there are disposed a discharging claw, 108 for peeling the printing sheet from the opposing drum 102, a pinch roller 109, and a discharging roller 110 for conveying the printing sheet. The printing sheet as printed is fed out by the discharging roller 110 onto a sheet discharging table 113.

According to the conventional stencil printing machine as explained above, the printing sheet is taken by the sheet supplying roller 106 and the timing roller 107, held by the holding claw 103 of the opposing drum 102 at the leading end thereof, and then conveyed along the outer circumferential surface of the opposing drum 102 upon rotation of the opposing drum 102. And, the printing sheet is printed while being held between the printing drum 100 and the opposing drum 102. The printing sheet as printed is released from the holding claw 103 and sent out by the discharging roller 110 onto the discharging table 113.

The conventional stencil printing machine includes a driving mechanism for vertically moving the sheet supplying table 105. Further, the printing machine includes a detecting means for detecting height of the printing sheets stacked on the sheet supplying table 105. This constitution allows the printing sheet on the sheet supplying table 105 to be situated to an optimum position for being sent out by the sheet supplying roller 106.

Further, the printing machine includes a driving mechanism for vertically moving the sheet discharging table 113. Further, the printing machine includes a detecting means for detecting height of the printing sheets stacked on the sheet discharging table 113. That constitution allows the discharging table 113 to be situated to a position such that the printing sheet as printed is discharged onto the sheet discharging table 113 without crimping and jamming so that the discharged sheets are orderly stacked.

However, according to the conventional stencil printing machine as explained above, the sheet supplying table 105 and the sheet discharging table 113 are situated to a front and a rear side of the printing drum 100 and the opposing drum 102, respectively, in a direction of conveying the printing sheet. Therefore, the driving mechanism and the detecting means are required to be provided to each of the sheet supplying table 105 and the sheet discharging table 113. Further, a control means is necessary for each of the sheet supplying table 105 and the sheet discharging table 113 for controlling movement of them. Further, enough space must be ensured for each of the sheet supplying table 105 and the sheet discharging table 113 for allowing them to move vertically. Additionally, the sheet supplying table 105 includes an adjustable sheet supplying fence 115 for guiding an outer edge of the printing sheet, and the sheet discharging table 113 includes an adjustable sheet discharging fence 116 for guiding the outer edge of the printing sheet. And, the sheet supplying fence 115 and the sheet discharging fence 116 must be adjusted according to a size of the printing sheet, respectively.

Further more, in the case where both sides of the printing sheet is needed to be printed, after the printing sheets are printed on one surface thereof, the printing sheets stacked on the sheet discharging table 113 are taken therefrom to be replaced on the sheet supplying table 105 upside-down. However, such operation that the printing sheets are moved from one table to another is troublesome. And, during the operation, the stacked sheets may shift to be rubbed with each other, thereby being deteriorated in printed image quality.

An object of the present invention is to provide an image forming machine of simple constitution that is capable of conducting optimum sheet supplying/discharging operations by moving the sheet supplying/discharging tables interlocked with each other and facilitating handling of the printing sheets during both sides printing.

SUMMARY OF THE INVENTION

An image forming machine defined in a first aspect of the present invention comprises an image forming section for receiving a sheet supplied in a supplying direction, printing an image on the sheet, and discharging the printed sheet in a discharging direction opposite to the supplying direction while changing the sheet upside-down; a sheet supplying table situated adjacent to the image forming section, the sheet supplying table stacking the sheet to be supplied to the image forming section; a sheet discharging table situated adjacent to the image forming section and disposed vertically relative to the sheet supplying table, the sheet discharging table stacking the sheet having the image printed thereon and discharged from the image forming section; and driving mechanism attached to the sheet supplying table and the sheet discharging table for vertically moving the sheet supplying table and the sheet discharging table in directions opposite to each other.

According to an image forming machine as defined in a second aspect of the present invention, in the image forming machine of the first aspect, the image forming machine further comprises sheet cassettes detachably attached to the sheet supplying table and the sheet discharging table for stacking the sheet thereon.

According to an image forming machine as defined in a third aspect of the present invention, in the image forming machine of the second aspect, the sheet cassette at the sheet discharging table and the sheet cassette at the sheet supplying table are exchangeable so that after the sheet supplied from the sheet cassette at the sheet supplying table is printed on one surface thereof by the image forming section and discharged to the sheet cassette at the sheet discharging table, the sheet cassettes at the sheet discharging table and the sheet supplying table are exchanged to allow the sheets in the cassette at the sheet supplying table to be supplied to the image forming section for printing an image on the other surface thereof.

According to an image forming machine as defined in a fourth aspect of the present invention, in the image forming machine of the second aspect, the sheet cassette is variable in shape between a flat form and a concave form directing downwards in a section perpendicular to the discharging direction, the sheet supplying table holds the sheet cassette in the flat form, and the sheet discharging table holds the sheet cassette in the concave form.

According to an image forming machine as defined in a fifth aspect of the present invention, in the image forming machine of the second aspect, the image forming machine further comprises a pair of side plates disposed parallel to the supplying and discharging directions of the sheet on two sides of the sheet cassettes of the sheet supplying table and the sheet discharging table, respectively, the pair of the side plates guides side edges of the sheet stacked on the sheet cassette.

According to an image forming machine as defined in a sixth aspect of the present invention, in the image forming machine of the first aspect, the driving mechanism comprises a first rack fixed to the sheet supplying table, a second rack fixed to the sheet discharging table, a pinion engaging the first rack and the second rack, and a motor for driving the pinion.

According to an image forming machine as defined in a seventh aspect of the present invention, in the image forming machine of the first aspect, the image forming machine further comprises a sensor for detecting the sheet on the sheet supplying table in a sheet supplying position, and control means for controlling the sheet supplying table so that the sheet supplying table moves upwards until the sensor detects the sheet on the sheet supplying table in the sheet supplying position.

According to an image forming machine as defined in an eighth aspect of the present invention, in the image forming machine of the seventh aspect, the image forming machine further comprises a sheet supplying roller situated vertically movably within a vertical range, the sensor is situated above the sheet supplying roller for detecting an upward movement of the sheet supplying roller when the sheet comes in the sheet supplying position.

In the constitution as described above, the printing sheets stacked on the sheet supplying table are successively fed out to the image forming section one by one, thereby decreasing in stack height. The printing sheets as printed are successively received by the discharging table and stacked thereon, thereby increasing in stack height. The driving mechanism moves the sheet supplying table upwards according to feeding-out of the printing sheet from the sheet supplying table. Simultaneously with the upward movement, the driving mechanism also moves the sheet discharging table downwards according to reception of the printed sheets into the sheet discharging table.

The printing sheet fed out from the sheet supplying table is printed on one surface thereof by the image forming section, and then discharged onto the sheet discharging table. Here, when the one surface is a top face of the printing sheet stacked on the sheet supplying table, the printing sheet is discharged onto the sheet discharging table with the printed one surface downward. Now, exchangeable sheet cassettes are attached to the sheet supplying table and the sheet discharging table. The printing sheets on the sheet supplying table and the sheet discharging table are placed on the cassettes, respectively. In this constitution, after all of the printing sheets are printed on one surface thereof, the cassette on the sheet discharging table is detached therefrom and attached to the sheet supplying table, and the cassette detached from the sheet supplying table is attached to the sheet discharging table. Then, printing to the other surfaces of the printing sheets is started. In this way, printing of the printing sheets can be performed successively from one surface to the other without changing the printed sheets stacked on the cassette upside-down.

DETAILED DESCRIPTION OF PREFERRED EMBODIMENTS

A preferred embodiment of the present invention will be explained referring to FIGS. 1 to 4. This embodiment relates to a stencil printing machine as an image forming machine.

Figure 1:
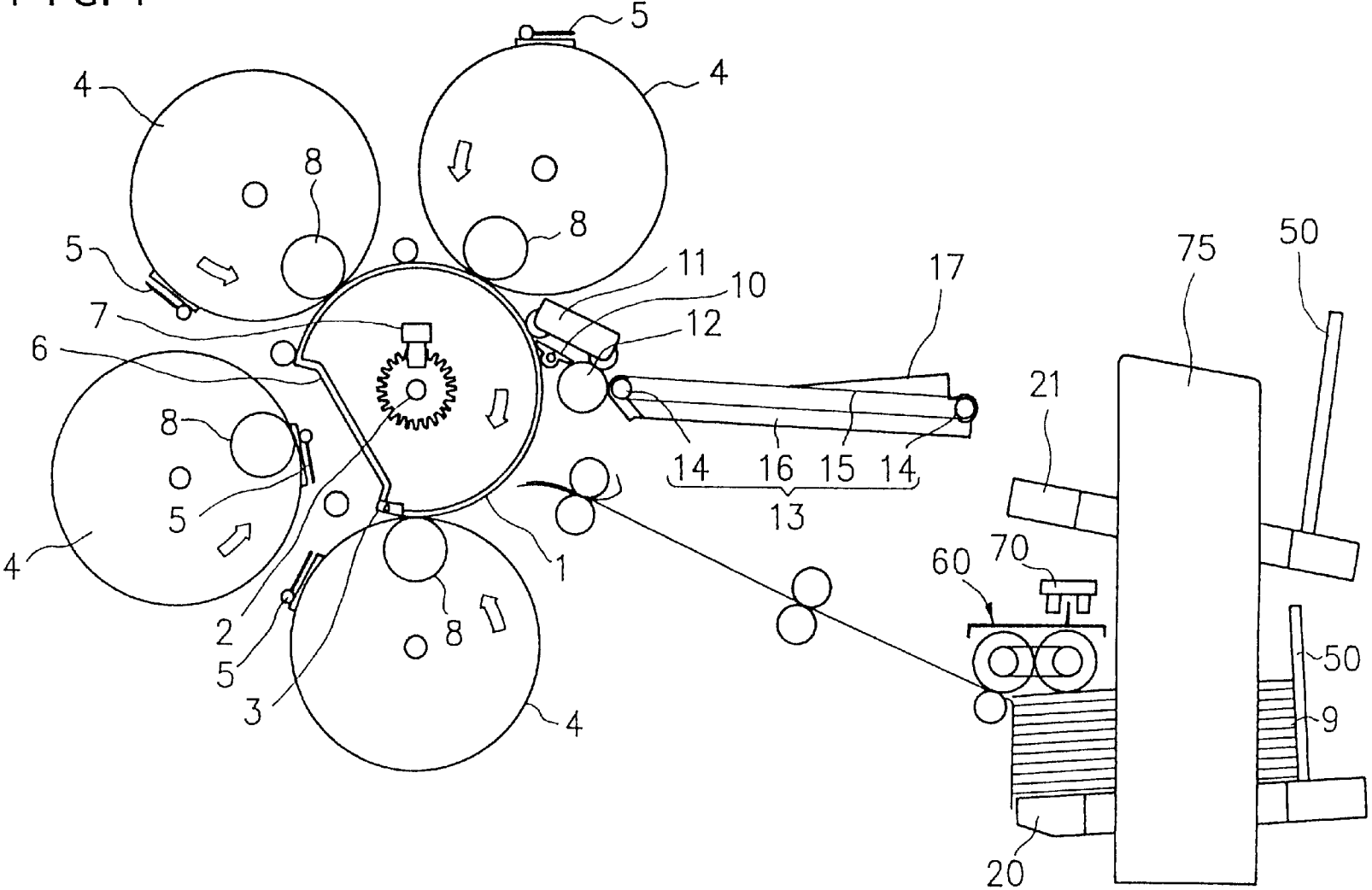
FIG. 1 is a front view of a stencil printing machine of one embodiment of the present invention.

Referring to FIG. 1, the entire constitution of the stencil printing machine will be explained. A cylindrical paper drum 1 as a pressing roller is rotatable around an axis 2. A holding claw 3 is attached to an outer circumferential surface of the paper drum 1 for holding a leading end of a printing sheet. A recess 6 is formed in a part of the outer circumferential surface of the paper drum 1 for avoiding interference with a clamping device 5 of a printing drum 4, which will be explained later. Rotational frequency detecting means 7 is situated adjacent to the axis 2.

Four cylindrical printing drums 4 are situated around the paper drum 1. The four printing drums 4 are arranged to be spaced apart at a predetermined angular interval in a rotational direction of the paper drum 1. The diameter of the printing drum 4 is approximately identical to that of the paper drum 1. An axis of the printing drum 4 is parallel to that of the paper drum 1. The printing drums 4 are each arranged to substantially contact the outer circumferential surface of the paper drum 1.

The printing drums 4 are rotatable around axes thereof An ink permeable area is formed in a circumferential wall of the printing drum 4. Inside the printing drum 4, an ink supplying means 8 is situated for supplying ink to an inner surface of the circumferential wall. A clamping device 5 is attached to an outer surface of the circumferential wall of the printing drum 4 for holding a leading end of a stencil sheet. The stencil sheet is wound around the printing drum 4 with the leading end held by the clamping device 5.

The printing drums 4 and the paper drum 1 are rotated by a common driving means in synchronization with each other. Rotational direction of the printing drum 4 is opposite to that of the paper drum 1. During rotation, the clamping device 5 of the printing drum 4 does not contact the outer circumferential surface of the paper drum 1 since it meets the recess 6 of the paper drum 1. Rotational speed of the printing drum 4 and the paper drum 1 determines printing speed. The printing speed, namely the rotational speed of the printing drum 4 and the paper drum 1, can be selected for setting from predetermined plural choices.

The four printing drums 4 perform printing with ink colors of cyan, magenta, yellow and black, respectively. The stencil sheets perforated according to the ink colors are wrapped around the outer circumferential surfaces of the printing drums 4, respectively. That is, an original image of full color is separated into four images of different colors. And, the four stencil sheets are perforated according to the four images of different colors, and the perforated stencil sheets are attached to the printing drums 4, respectively. The paper drum 1 holds a printing sheet 9 with the holding claw 3 and conveys it along the outer circumferential surface thereof The printing sheet 9 is overprinted by the stencil sheet of each color while being pinched successively between the paper drum 1 and each of the printing drums 4. Thus, the original image of full color is formed on the printing sheet 9. Of course, multicolor printing can be performed.

As illustrated in FIG. 1, on a discharging side of the paper drum 1, a paper discharging claw 10 is situated adjacent to the outer 10 circumferential surface of the paper drum 1. The paper discharging claw 10 peels the printing sheet 9 from the paper drum 1.

As illustrated in FIG. 1, a pinch roller 11 is disposed adjacent to the paper drum 1. The pinch roller 11 includes two pairs of rollers contacting both side edges of the printing sheet 9 in a width direction thereof, respectively. Since the both side edges of the printing sheet 9 have no images printed thereon, the pinch roller 11 does not contact the printed image.

As illustrated in FIG. 1, a discharging roller 12 is situated below a forward side of the pinch roller 11 in a conveying direction of the printing sheet 9. The discharging roller 12 contacts a bottom surface of the printing sheet 9. The discharging roller 12 in the present invention is driven by the driving means of the printing drums 4 and the paper drum 1.

As illustrated in FIG. 1, a conveying mechanism 13 is situated adjacent to the discharging roller 12. The conveying mechanism 13 is continuously operated during printing. The conveying mechanism 13 transfers the printing sheet 9 conveyed by the pinch roller 11 and the discharging roller 12 into a sheet discharging table, which will be explained later, at a speed required for efficient sheet-discharging. The conveying mechanism 13 in the present embodiment includes two belts 15 connecting pulleys 14 and suction means 16 situated below the belts 15. The suction means 16 holds the printing sheet 9 on the belts 15. The conveying mechanism 13 may be driven by the driving means of the printing drum 4, the paper drum 1, and the discharging roller 12, or may be driven by other driving source.

As illustrated in FIG. 1, a sheet throwing stand 17 is attached to an end of the conveying mechanism 13. The sheet throwing stand 17 has an upward slope ascending in the conveying direction of the printing sheet 9 for assisting the conveyed printing sheet 9 to be thrown out.

As illustrated in FIG. 1, a sheet supplying table 20 and the sheet discharging table 21 are situated adjacent to the conveying mechanism 13 in a throwing direction of the printing sheet 9. Constitution and operation of the sheet supplying table 20 and the sheet discharging table 21 will be explained referring to FIGS. 2 to 4.

Figure 3:
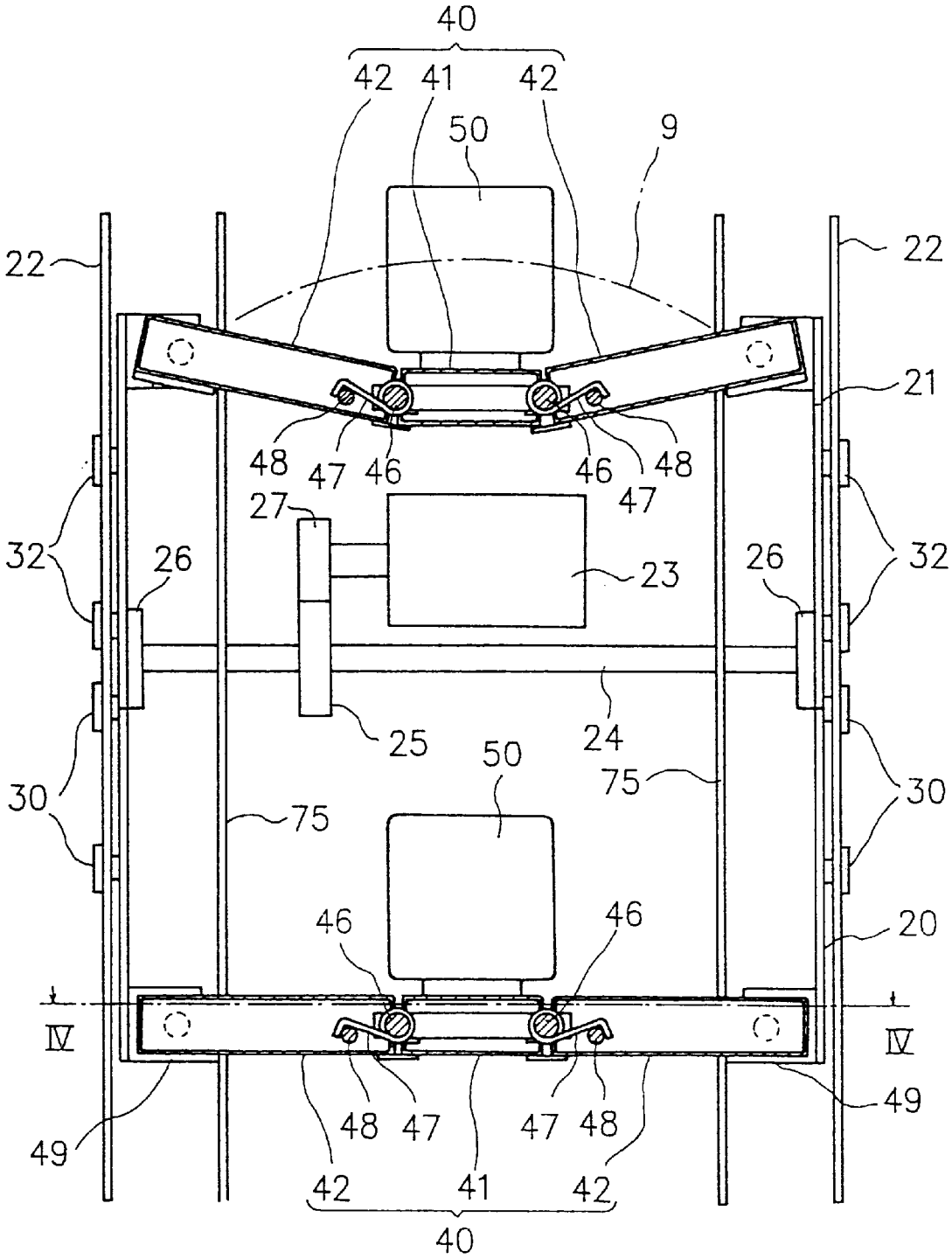
FIG. 3 is a vertical sectional view of the sheet supplying device and the sheet discharging device seen from a right side of the embodiment, namely a sectional view taken along a line III—III of FIG. 4.

FIG. 3 is a sectional view of the sheet supplying table 20 and the sheet discharging table 21. This is taken along a face perpendicular to the sheet conveying direction or a sheet discharging direction. A pair of frames 22 is situated parallel to the sheet conveying direction and the sheet discharging direction at a predetermined distance therebetween. A motor 23 is situated between the pair of the frames 22 as a driving source for a driving mechanism, and attached to a not-shown frame. A main shaft 24 is rotatably situated between the pair of the frames 22. A driven gear 25 is attached to an approximately center portion of the main shaft 24. Two pinions 26 are attached to both ends of the main shaft 24 adjacent to inner surfaces of the frames 22, respectively. A driving gear 27 attached to a driving shaft of the motor 23 engages the driven gear 25. When the motor 23 is energized, the main shaft 24 is rotated.

Each of the frames 22 includes vertical guiding grooves 28, 29 formed therein. The sheet supplying table 20 is vertically movably mounted on the lower guiding grooves 29, 29 with guiding rollers 30, 30. A rack 31 is formed in the sheet supplying table 20, and the rack 31 engages the pinion 26 on the main shaft 24. Further, the sheet discharging table 21 is vertically movably mounted on the upper guiding grooves 28, 28 with guiding rollers 32, 32. A rack 33 is formed in the sheet discharging table 21, and the rack 33 engages the pinion 26 on the main shaft 4. Accordingly, when the motor 23 is energized, the pinion 26 is rotated to move the sheet supplying table 20 and the sheet discharging table 21 vertically in directions opposite to each other.

Length and position of the guiding grooves 28, 29 are so arranged that, when the sheet supplying table 20 with the maximum number of the printing sheets stacked thereon is located most distant from the sheet discharging table 21, the sheet discharging table 21 is situated to the best position for receiving the first printing sheet as printed and discharged. Further, when the sheet discharging table 21 with the maximum number of the printing sheets stacked thereon is located most closest to the sheet supplying table 20, the sheet supplying table 20 is situated to the best position for supplying the last printing sheet.

Figure 4:
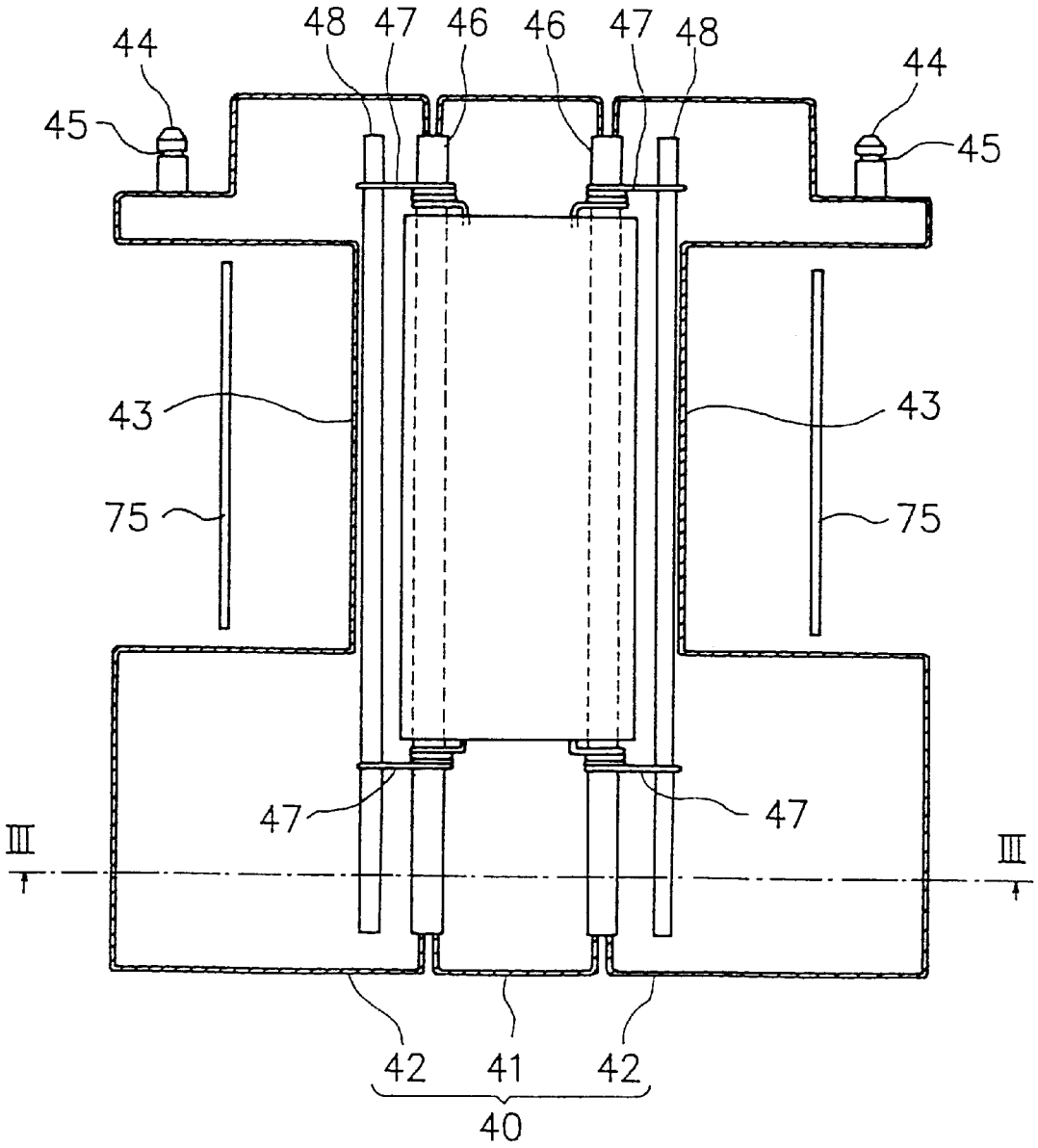
FIG. 4 is a horizontal sectional view of a cassette and side plates of the embodiment, namely a sectional view taken along a line IV—IV of FIG. 3.
Figure 5:
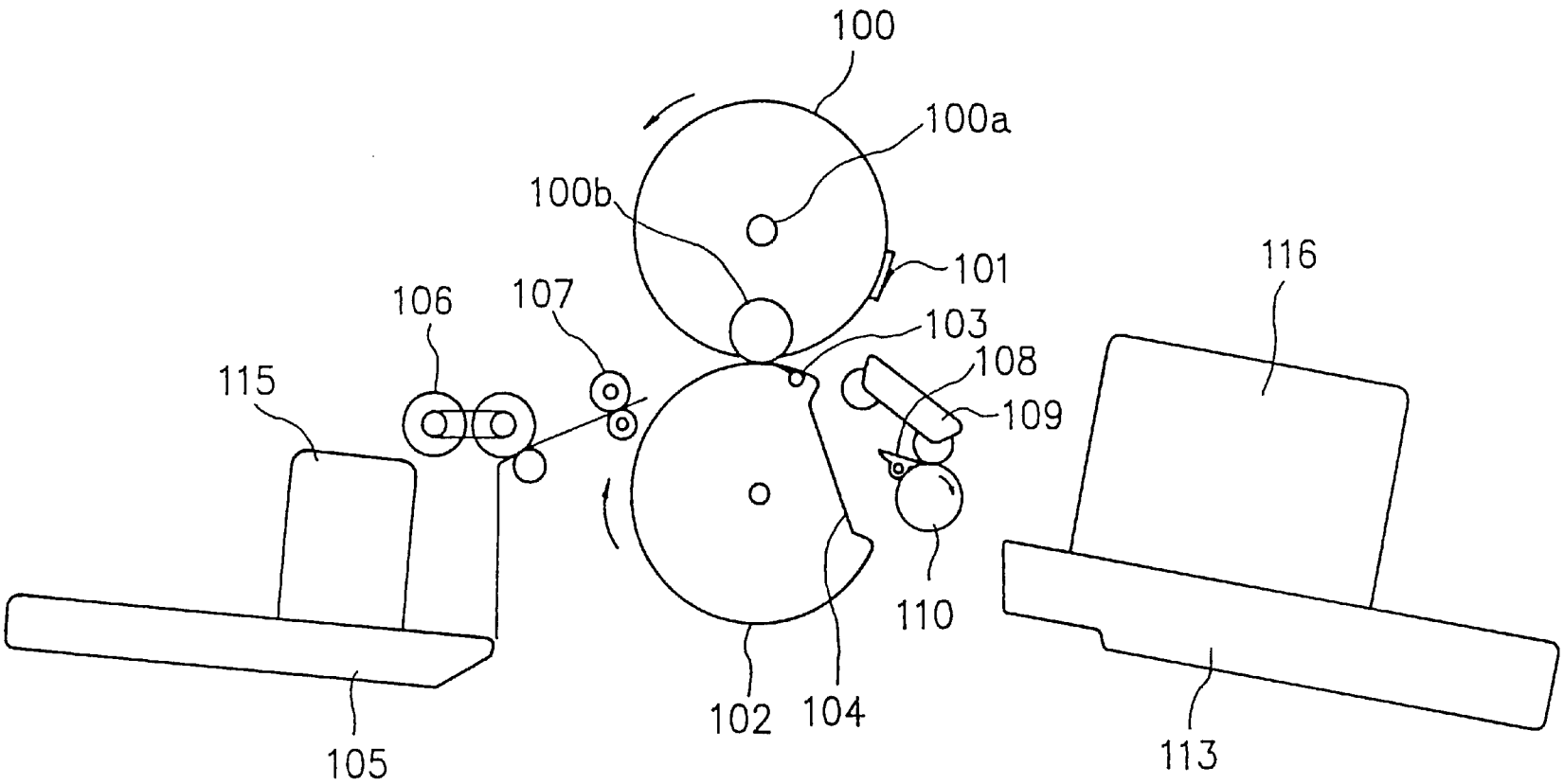
FIG. 5 PRIOR ART
FIG. 5 is a schematic view illustrating a conventional stencil printing machine.

Sheet cassettes 40 (hereinafter referred to as "a cassette 40") are mounted on the sheet supplying table 20 and the sheet discharging table 21, and attached thereto. This cassette 40 is adaptable to both the sheet supplying table 20 and the sheet discharging table 21. As illustrated in FIGS. 3 and 4, the cassette 40 includes three members of box-shape, i.e. a rectangular center portion 41 and two side portions 42, 42. As illustrated in FIG. 4, a recess 43 is formed in an approximately center portion of the side portion 42. A connecting rod 44 is attached to a front face of the side portion 42 for connecting therewith the sheet supplying table 20 or the sheet discharging table 21. A circumferential groove 45 is formed on a front end of the connecting rod 44. The side portion 42 is rotatably attached to the center portion 41 with a rotational axis 46. A spring 47 fitted on the rotational axis 46 is hooked at an axis 48 attached to the side portion 42, thereby urging the center portion 41 downwards relative to the side portion 42. Accordingly, when the cassette 40 is not maintained unchanged in an outer shape thereof by any means, like the cassette 40 mounted on the sheet discharging table 21 illustrated in FIG. 3, the cassette 40 shows a concave form with the center thereof projecting downwards. Further, like the cassette 40 mounted on the sheet supplying table 20 illustrated in FIG. 3, when the cassette 40 is not allowed to deform while being held with both side edges thereof by retaining members 49, 49, the cassette 40 shows a flat form wherein the center portion 41 and the side portions 42, 42 are approximately in the same surface.

An outer form and dimensions of the cassette 40 is so designed that the printing sheet can be stably stacked thereon during printing by the image forming machine. Further, the cassette is such that it can be held stable in shape when the cassette with printing sheets stacked thereon is attached to or detached from the sheet supplying table and the sheet discharging table, and when the cassette detached from the sheet supplying table or the sheet discharging table is carried by hands.

As illustrated in FIGS. 1 and 3, a collision plate 50 is attached to the rear of an upside of the cassette 40. The collision plate 50 is movable back and forth in the discharging direction of the printing sheet 9.

Figure 2:
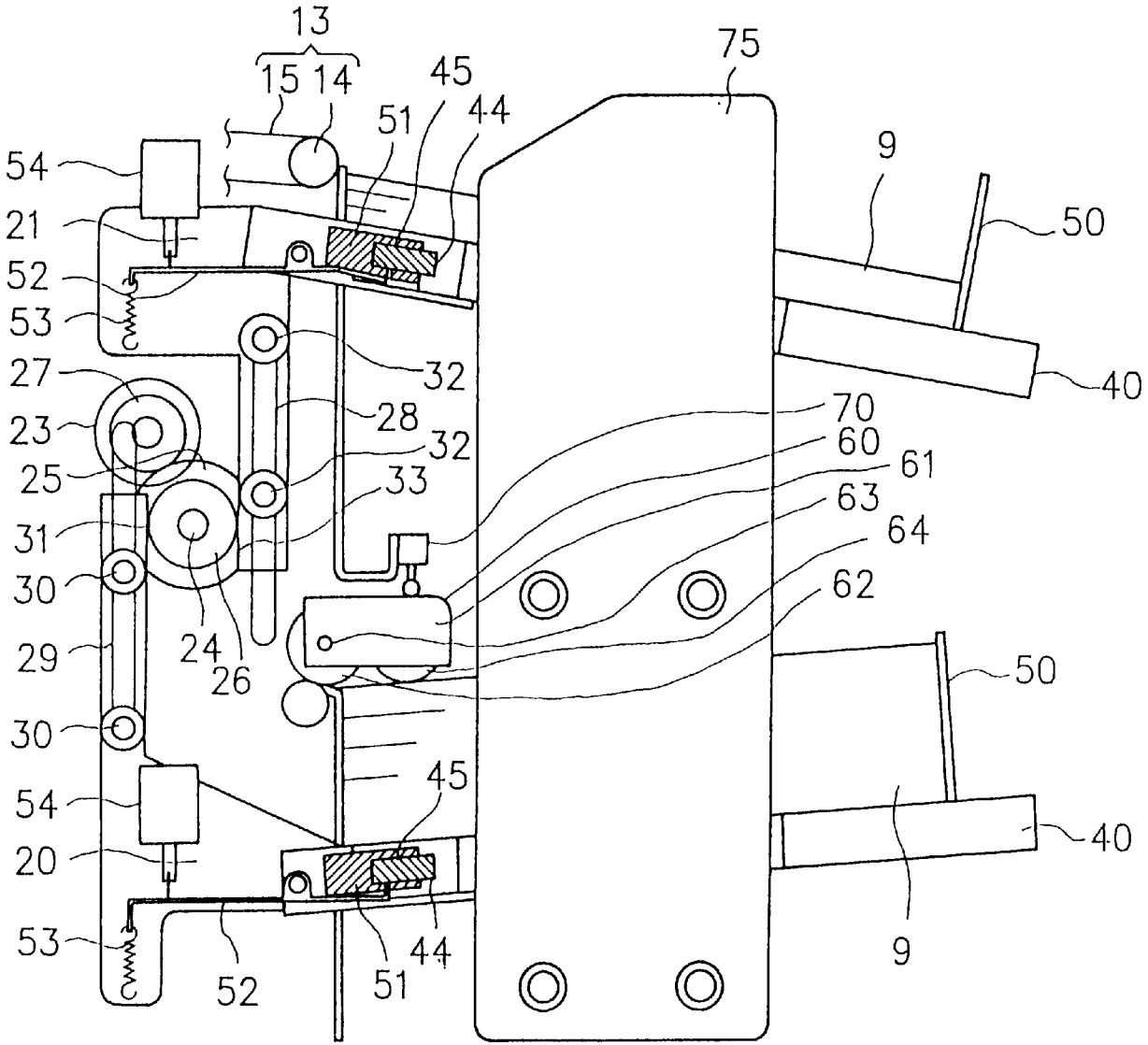
FIG. 2 is a front view of a sheet supplying device and a sheet discharging device of the embodiment.

As illustrated in FIG. 2, a locking device is provided to each of the sheet supplying table 20 and the sheet discharging table 21 for fixing the connecting rod 44 attached to the front part of the cassette 40. Constitution of the locking device will be explained referring to the sheet supplying table 20 as an example. A connecting member 51 is attached to each of both side portions of the front of the sheet supplying table 20. The connecting member 51 has a hole formed therein for receiving the connecting rod 44 of the cassette 40. A lever 52 is disposed adjacent to the connecting member 51 and pivotally attached to the sheet supplying table 20. Actually, the center of the lever 52 is pivotally attached to the sheet supplying table 20 by an axis. A front end of the lever 52 can be entered and go out of the hole of the connecting member 51. When the end enters the hole, this engages the circumferential groove 45 of the connecting rod 44 inserted in the hole, thereby locking the cassette 40. A spring 53 is connected to the rear of the lever 52, thereby urging the lever 52 to move so that the front end is projected inside the hole. A solenoid 54 is attached to the front of the sheet supplying table 20. The solenoid 54 has an operating axis downwards. The operating axis of the solenoid 54 is connected to the rear of the lever 52. When the rear of the lever 52 is lifted up by energizing the solenoid 54, the front end of the lever 52 moves out of the hole, thereby disengaging the connecting rod 44 from the lever 52.

As described above, the locking device for fixing the cassette 40 is also provided to the sheet discharging table 21. Constitution and operation thereof is identical to that of the sheet supplying table 20.

As illustrated in FIGS, 1 and 2, a sheet supplying roller 60 is situated adjacent to the sheet supplying table 20 in the present machine. The sheet supplying roller 60 includes two rollers. The two rollers are rotatably supported on a common supporting plate 61. One roller is a conveying roller 62 situated to one side of the supporting plate near the paper drum. An axis 63 of the conveying roller is attached to a main frame of the present machine. The other roller is a fetching roller 64 situated to the other side of the supporting plate distant from the paper drum. The fetching roller 64 is vertically movable around the axis 63 within a predetermined vertical range. The fetching roller 64 is kept to be slightly lifted up by the printing sheets 9 arranged at a supplying position. In this state, if the sheet supplying roller 60 is driven, a top printing sheet is fed out.

A switch 70 as a sensor is situated above the sheet supplying roller 60. Height of the printing sheets 9 stacked on the sheet supplying table decreases as the printing sheets 9 are fed out one by one. The fetching roller 64 moves vertically downwardly around the axis 63. The sheet supplying roller 60 leaves the switch 70, thereby allowing it to be turned off. A control means not shown here energizes the motor 23 to move the sheet supplying table 20 vertically. The uppermost printing sheet 9 on the sheet supplying table comes to the sheet supplying position, thereby lifting up the sheet supplying roller 60. The sheet supplying roller 60 pushes up the switch 70 to be turned on while being lifted up. The control means receives a signal from the switch to stop the motor 23.

As illustrated in FIGS. 2 to 4, a pair of side plates 75, 75 is disposed parallel to the sheet supplying and discharging directions on two sides of the cassettes 40 mounted on the sheet supplying table and the sheet discharging table, respectively. The side plate 75 is detachably attached to a frame of the present machine. The side plate 75 is situated in the recess 43 of the cassette 40, and can be detached therefrom when the cassette 40 is attached to or detached from the sheet supplying table 20 or the sheet discharging table 21. The side plate 75 is common to the sheet supplying table 20 and the sheet discharging table 21. That is, the side plates 75 guide two side edges of the printing sheet 9 supplied from the cassette 40 at the sheet supplying table 20, and also guide two side edges of the printing sheet 9 discharged onto the cassette 40 at the sheet discharging table 21.

Both sides printing in the present stencil printing machine will be explained.

Many printing sheets 9 are stacked on the cassette 40, and the cassette 40 is mounted on the lower sheet supplying table 20. The connecting rods 44 attached to the front of the cassette 40 are inserted into the holes of the connecting member 51. The front ends of the lever 52 engage the circumferential grooves 45 of the connecting rods 44, so that the cassette 40 is fixed to the sheet supplying table 20. Then, since the both side edges of the cassette 40 are held by the retaining members 49, 49, the cassette 40 is fixed to the sheet supplying table 20 as it shows a flat form wherein the center portion 41 and the side portions 42, 42 are approximately in the same surface.

An empty cassette 40 is attached to the sheet discharging table 21. The cassette 40 shows a concave form directing downwards since the sheet discharging table has no holding means such as the retaining member 49 formed at the sheet supplying table 20.

A first process of the both sides printing is started. In this process, the printing sheet is printed on one surface thereof The one surface of the printing sheet faces downward in the printing sheet stacked on the sheet supplying table 20.

An uppermost printing sheet 9 is took out by the sheet supplying roller 60 from among the printing sheets 9 stacked on the sheet supplying table 20, and then conveyed to the printing drum 4 and the paper drum 1. Then, the printing sheet 9 is held by the holding claw 3 by the leading end thereof The printing sheet 9 is conveyed along the outer circumferential surface of the paper drum 1 upon rotation of the paper drum 1. Four images of different four colors are successively printed on the printing sheet 9 as the printing sheet is conveyed while being pinched between the four printing drums 4 and the paper drum 1.

After that, the printing sheet 9 is peeled off from the paper drum 1 by the pinch roller 11 and the paper discharging claw 10, and then conveyed to the discharging roller 12. The conveying mechanism 13 further conveys the printing sheet 9, thereby throwing the printing sheet from the sheet throwing stand 17. The printing sheet 9 collides with the collision plate 50, and drops onto the sheet discharging table 21.

The printing sheet 9 printed in the first process enters the cassette 40 at the sheet discharging table 21 with the one surface thereof facing upward. The printing sheet 9 with ink adhered to the upper surface thereof shows a convex form projecting upwards as illustrated by an imaginary line in FIG. 3. The cassette 40 at the sheet discharging table 21 has the form opposite to that of the printing sheet as printed on the upper surface thereof. Therefore, deformation of the printing sheet can be corrected by stacking the printing sheet on the cassette at the sheet discharging table.

As printing proceeds, height of the printing sheets 9 stacked on the sheet supplying table 20 decreases. The printing sheets 9 as printed are successively stacked on the sheet discharging table, and height thereof increases. The control means energizes the motor 23 to move the sheet supplying table 20 upwards according to supplying of the printing sheets 9. That movement allows a mechanism to drive the sheet discharging table 21 downward according to receiving of the printing sheets 9 as printed.

That is, since the sheet supplying table 20 and the sheet discharging table 21 are moved together by combination of the racks 31, 33 and the pinion 26, the tables 20,21 move upwards and downwards, respectively, in the same distance. And, during printing, the printing sheets 9 just transfer to the sheet discharging table 21 from the sheet supplying table 21, thereby maintaining total weights thereof. Accordingly, the driving source can be common to the sheet supplying side and the sheet discharging side. Further, it is not necessary to detect the printing sheets 9 as discharged for controlling movement of the sheet discharging table 21. Just controlling the sheet supplying side enables the uppermost printing sheet 9 on the sheet discharging side to be kept in a constant position, thereby allowing the printing sheet as discharged to properly enter the cassette 40 at the sheet discharging table 21.

Upon completion of the first process of printing for all of the printing sheets 9, after the side plates 75 are removed, the empty cassette 40 at the sheet supplying table 20 and the cassette 40 at the sheet discharging table 21 are detached. The cassette 40 having printed printing sheets 9 stacked thereon is attached to the sheet supplying table 20. The empty cassette 40 at the sheet supplying table 20 is attached to the sheet discharging table 21. During such operation, the printing sheets 9 stacked on the cassette 40 need not be touched. It is not necessary for the printed sheets to be inverted and replaced on the sheet supplying table as is usual in conventional art. The printing sheet 9 is stacked on the cassette 40 with the printed surface facing upward. Just attaching the cassette 40 to the sheet supplying table 20 allows the printing sheet to be printed on the other surface thereof A second process of the printing is started. In this process, the printing sheet 9 is printed on the other surface thereof. The other surface faces downward in the printing sheet 9 on the cassette 40 at the sheet supplying table 20.

In the stencil printing machine of the present embodiment, the driving mechanism for moving the sheet supplying table 20 and the sheet discharging table 21 is composed of the racks 31, 33 and the pinion 26 driven by the motor 23. Driving force transmission means such as a belt or a chain may be used instead.

The stencil printing machine of the present embodiment as described above includes the rigid paper drum 1 and the four printing drums 4; however, constitution for enabling printing in the present invention is not restricted to that of the embodiment. For example, the present invention may be adapted to a stencil printing machine comprising one paper drum and one printing drum. Further, the present invention may be adapted to a stencil printing machine comprising a vertically movable pressing roller situated adjacent to the rotating printing drum. In such a machine, a printing sheet is supplied between the printing drum and the pressing roller, and pressed against the rotating printing drum by moving the pressing roller upwards, thereby conducting printing. More further, the present invention may be adapted to a stencil printing machine comprising a printing drum having a deformable circumferential wall, means for supplying ink to an inner surface of the circumferential wall, and pressing means situated inside the circumferential wall for pressing the circumferential wall. In this machine, an opposing roller is situated to a predetermined position adjacent to the printing drum. In such a machine, a printing sheet is supplied between the printing drum and the opposing roller, and pressing means presses the circumferential wall of the printing drum to be deformed outwardly, so that the printing sheet is pinched therebetween, thereby conducting printing.

Additionally, a mechanism for image forming in the present invention is not restricted to that for printing. The present invention may be adapted to any image forming machine of other principles. However, it is necessary that sheet supplying and discharging directions be opposite to each other, and that the printed sheet be changed upside-down when being discharged.

In the image forming machine of the present invention, the sheet supplying table and the sheet discharging table are disposed vertically relative to each other, and moved together by the common driving mechanism. Accordingly, the constitution of the machine is simple, and sheet discharging can be properly conducted by associated movement of the sheet supplying and discharging tables. Further, if the exchangeable cassettes are provided to the sheet supplying table and the sheet discharging table, when both sides printing is conducted, it is only necessary that the cassettes be changed without inverting the printing sheets. That means handling of the printing sheets is simplified.

What is claimed is:

1. An image forming machine, comprising:

an image forming section for receiving a sheet supplied in a supplying direction, printing an image on said sheet, and discharging said printed sheet in a discharging direction opposite to said supplying direction while changing said sheet upside-down, a sheet supplying table situated adjacent to said image forming section, said sheet supplying table stacking said sheet to be supplied to said image forming section, a sheet discharging table situated adjacent to said image forming section and disposed vertically relative to said sheet supplying table, said sheet discharging table stacking said sheet having said image printed thereon and discharged from said image forming section, and a driving mechanism attached to said sheet supplying table and said sheet discharging table for vertically moving said sheet supplying table and said sheet discharging table in directions opposite to each other.

2. An image forming machine as claimed in claim 1, further comprising sheet cassettes detachably attached to said sheet supplying table and said sheet discharging table for stacking said sheet thereon.

3. An image forming machine as claimed in claim 2, wherein said sheet cassette at said sheet discharging table and said sheet cassette at said sheet supplying table are exchangeable so that after said sheet supplied from said sheet cassette at said sheet supplying table is printed on one surface thereof by said image forming section and discharged to said sheet cassette at said sheet discharging table, said sheet cassettes at said sheet discharging table and said sheet supplying table are exchanged to allow said sheets in said cassette at said sheet supplying table to be supplied to said image forming section for printing an image on the other surface thereof.

4. An image forming machine as claimed in claim 2, wherein said sheet cassette is variable in shape between a flat form and a concave form directing downwards in a section perpendicular to said discharging direction, said sheet supplying table holding said sheet cassette in said flat form, and said sheet discharging table holding said sheet cassette in said concave form.

5. An image forming machine as claimed in claim 2, further comprising a pair of side plates disposed parallel to said supplying and discharging directions of said sheet on two sides of said sheet cassettes at said sheet supplying table and said sheet discharging table, respectively, said pair of side plates guiding side edges of said sheet stacked on said sheet cassette.

6. An image forming machine as claimed in claim 1, wherein said driving mechanism comprises a first rack fixed to said sheet supplying table, a second rack fixed to said sheet discharging table, a pinion engaging said first rack and the second rack, and a motor for driving said pinion.

7. An image forming machine as claimed in claim 1, further comprising a sensor for detecting said sheet on said sheet supplying table in a sheet supplying position, and control means for controlling said sheet supplying table so that said sheet supplying table moves upwards until said sensor detects said sheet on said sheet supplying table in said sheet supplying position.

8. An image forming machine as claimed in claim 7, further comprising a sheet supplying roller situated vertically movably within a vertical range, said sensor being situated above said sheet supplying roller and detecting an upward movement of said sheet supplying roller when said sheet comes in said sheet supplying position.

* * * * *